US006343525B1

(12) United States Patent
Nicolosi et al.

(10) Patent No.: US 6,343,525 B1
(45) Date of Patent: Feb. 5, 2002

(54) MANUAL DUAL OVERCENTER LATCH MECHANISM AND LOCK MECHANISM

(75) Inventors: Samuel Joseph Nicolosi, Webster; William A. Burton; Dara Nanette Lubin, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,353

(22) Filed: Nov. 24, 1999

(51) Int. Cl.[7] ..... G05G 5/06
(52) U.S. Cl. ..... 74/529; 74/535
(58) Field of Search ..... 74/528, 535, 529, 74/540

(56) References Cited

U.S. PATENT DOCUMENTS 3,255,852 A * 6/1966 Martin et al. ..... 192/4
3,367,208 A * 2/1968 Fender ..... 74/531
3,587,342 A * 6/1971 Yamazaki ..... 74/540

FOREIGN PATENT DOCUMENTS

JP 63-308618 * 12/1988 ..... 74/502.2

* cited by examiner

*Primary Examiner*—David A. Bucci
*Assistant Examiner*—Vicky A. Johnson
(74) *Attorney, Agent, or Firm*—Oliff & Berridge, PLC

(57) ABSTRACT

A locking mechanism selectively prevents rotational movement of a handle relative to a frame. The locking mechanism includes a fork member having first and second ends and pivotally attached to the frame member at a pivot located between the first and second ends; a first locking device located at the first end of the fork member; a second locking device located on the handle and engaging the first locking device on the first end of the fork member for preventing rotational movement of the handle; an elastic member for biasing the first and second locking devices into engagement; and an attachment mechanism located at the second end of the fork member. A tension force on the attachment mechanism pivots the fork member about the pivot member to disengage the first and second locking devices and allow the handle to rotate relative to the frame.

7 Claims, 7 Drawing Sheets

MANUAL DUAL OVERCENTER LATCH MECHANISM AND LOCK MECHANISM

BACKGROUND OF THE INVENTION

1. Field of Invention

The present invention relates to a latch mechanism used in manually moving and locking various objects.

2. Description of Related Art

In an image forming apparatus, a user often needs to gain access to the various components within the image forming apparatus for repairing, replacing, cleaning, or other service related matters. Thus, image forming apparatus are preferably constructed in a modular configuration in which components are latched into position but are capable of being unlatched for access to the components.

SUMMARY OF THE INVENTION

The present invention describes a latch mechanism which may be used wherever a large motion and large force is required in a small area by use of manual power. However, the latch mechanism will be described as applied to just one possible structure having heavy components which need to be moved manually, i.e. components of an image forming apparatus. Also, the latch mechanism allows the components being secured to be unlocked and separated so that a user may access the components and the parts in between and inside each component.

The latch mechanism in one possible configuration comprises a first member, a second member pivotably connected to the first member, and a handle connected to the second member. A latch mechanism selectively maintains a first component in a fixed position relative to a second component. The latch mechanism include a first member for selective attachment to the first component; and a second member for selective attachment to a second component and pivotally attached to the first member. The first and second members assume a locked position when the first and second members are substantially aligned and assume an unlocked position when the first and second members are traverse to each other. A handle is pivotally connected to the second member. A link member is pivotally connected at one end to the second member and pivotally connected at an opposite end to the handle. The link member assumes a first position when the handle is moved to a corresponding first handle position to have the link member positioned overcenter with respect the first and second members to brace the first and second members in a locked position. The link member also assumes a second position when the handle is moved to a corresponding second handle position to move the link member traverse or undercenter to the second member to allow the first and second members to pivot relative to each other. The link member maintains the first and second members in the locked position until the handle is moved from the first handle position to the second handle position. A link member, which is attached to the second member and the handle, aids in locking the two members and reducing the pivotal movement between the two members. Furthermore, a ball joint is attached to one end of the first member and a bracket is attached to one end of the second member. The ball joint allows the latch mechanism to pivot along the X axis, and the bracket allows the link mechanism to pivot along the X and Y axes. A spring arrangement may also be added which pulls the link member toward a locked position.

Furthermore, in an image forming apparatus, if a user moves the pre-fuser transport into proper position before disengaging or re-engaging the xerographic towers and other components, there is a chance that this could cause damage to the prefuser transport. Therefore, a locking mechanism has been designed to require movement of the pre-fuser transport before unlatching other components such as the xerographic towers.

This invention provides a latch mechanism which may be used wherever a large motion and a large force is required in a small area by manual power.

This invention separately provides a latch mechanism which locks one or more components together securely.

This invention separately provides a latch mechanism which allows the device to unlock and lock components very quickly.

This invention separately provides a lock mechanism which reduces the likelihood of the prefuser transport and the xerographic towers from colliding due to user's failing to follow proper procedures.

This invention separately provides a lock mechanism which may be cheaply made and may be implemented in an image forming apparatus.

BRIEF DESCRIPTION OF THE DRAWINGS

This invention will be described in relation to the following drawings, in which reference numerals refer to like elements, and wherein.

DETAILED DESCRIPTION OF PREFERRED EMBODIMENTS

Figure 1:
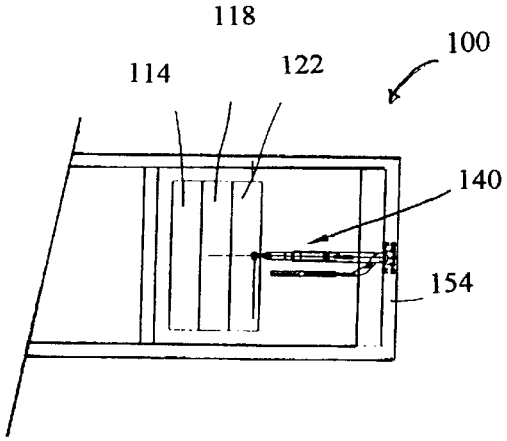
FIG. 1 is a top view of the image forming apparatus wherein the modular components and the latch mechanism are in a locked position.
Figure 2:
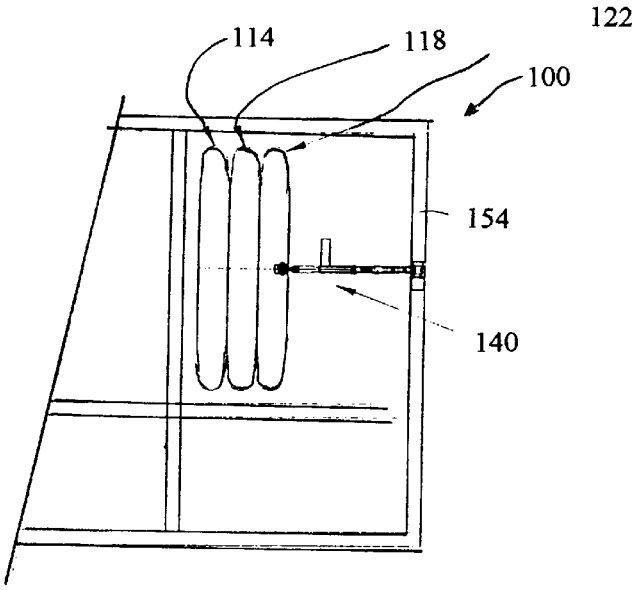
FIG. 2 is a front view of the image forming apparatus wherein the modular components and the latch mechanism are in a locked position.
Figure 3:
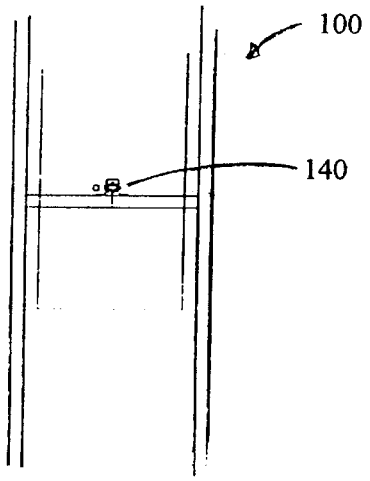
FIG. 3 is a right view of the image forming apparatus wherein the modular components and the latch mechanism are in a locked position.

FIGS. 1, 2 and 3 show the top, front and right view, respectively, of an image forming apparatus 100, conventionally having modular sections, in a locked position by a latch mechanism 140. It should be appreciated that the present invention may be used in various exemplary embodiments having various configurations, however, an explanation will be given with respect to one of many exemplary embodiments as shown in the figures discussed below.

As shown in the exemplary embodiment in FIGS. 1, 2 and 3, the image forming apparatus 100 is conventionally configured in modular sections having a left xerographic tower 114, a photoreceptor 118 and a right xerographic tower 122. Conventionally, a recording medium enters the image forming apparatus 100 and moves from the left xerographic tower 114 to the photoreceptor 118 and is finally received by the right xerographic tower 122. Each modular component (114, 118 and 122) contains various components which assist in forming the image on a recording medium.

Figure 4:
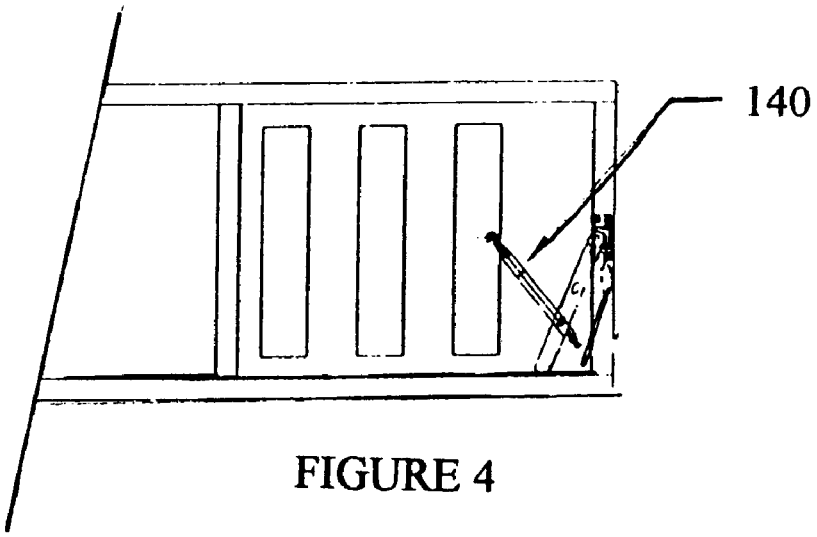
FIG. 4 is a top view of the image forming apparatus wherein the modular components and the latch mechanism are in a full open position.
Figure 5:
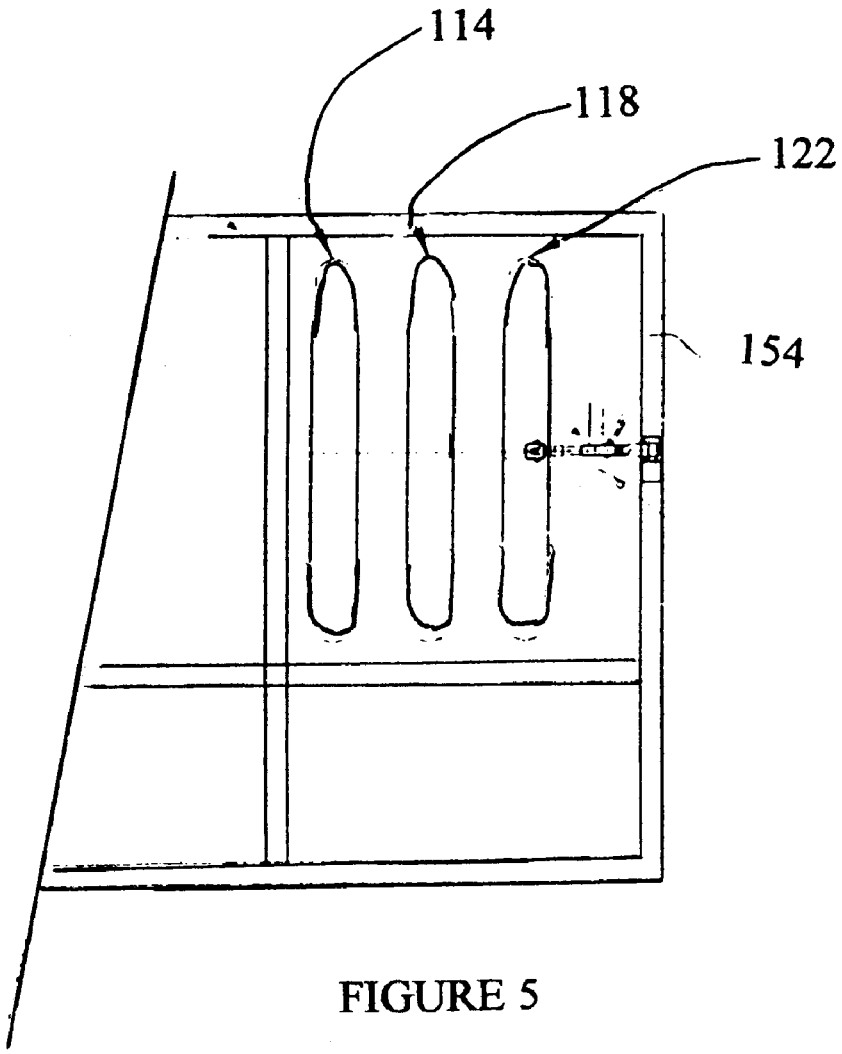
FIG. 5 is a front view of the image forming apparatus wherein the modular components and the latch mechanism are in a full open position.
Figure 6:
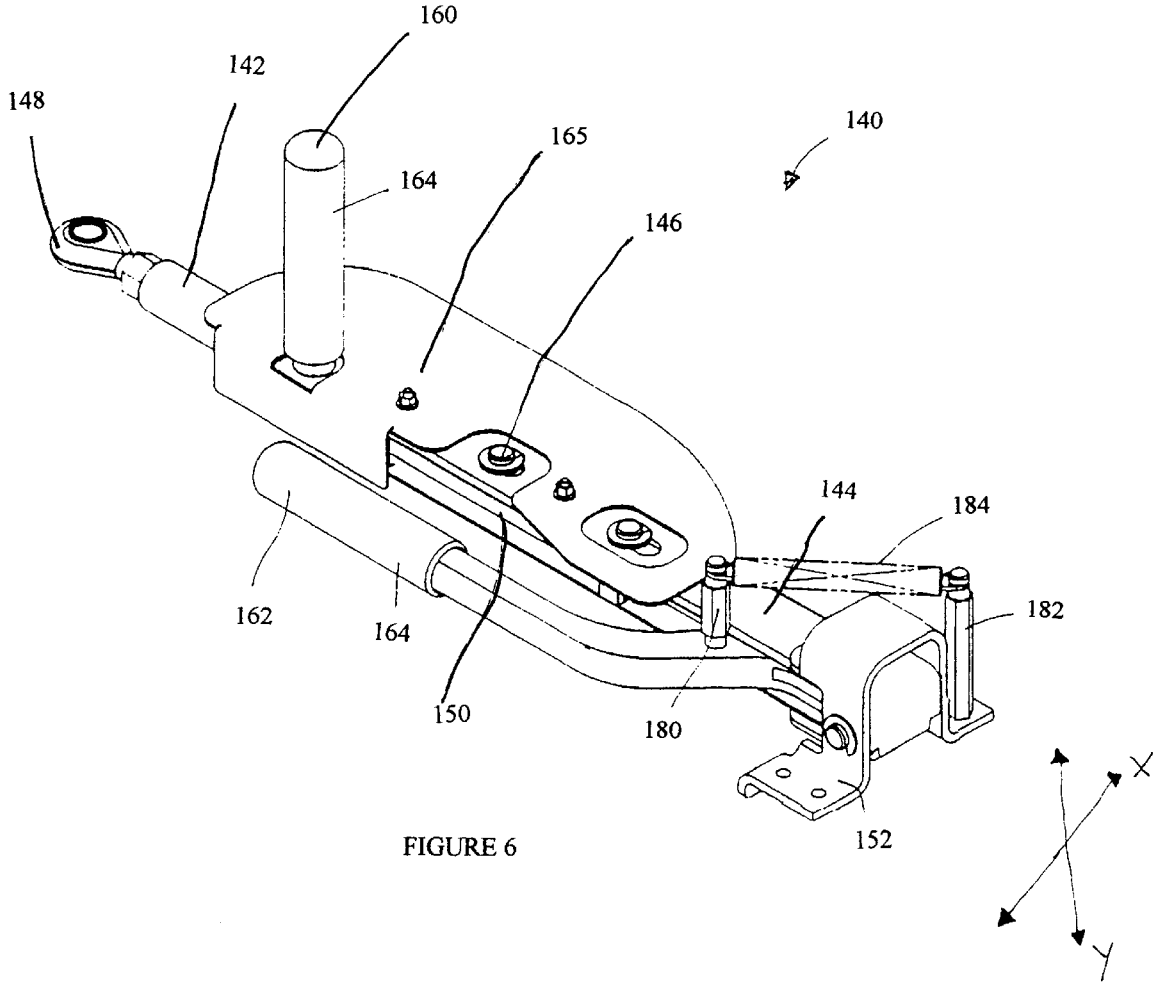
FIG. 6 is a perspective view of the latch mechanism.

When a user wishes to get access within the image forming apparatus 100 shown in FIGS. 1–3, the modular components must be separated, as shown in FIGS. 4 and 5, so that the user can access the individual components within the image forming apparatus to replace, clean, fix or to perform other service related matters. A device is necessary to enable the modular components to come apart, or be separated from one another, and then placed back into a locked position. Once the modular components are placed in a locked position, it is critical that these members stay in a stationary or fixed position relative to each other, and return to their original position. Therefore, the present invention, as illustrated in FIG. 6, shows one exemplary embodiment of a latch mechanism 140 which enables the modular components to come apart and become separated from one another and also enables the modular components to move back into a locked position. This advantage along with other advantages will become more apparent during the description of the latch mechanism 140 as described below.

FIG. 6 illustrates one exemplary embodiment of a latch mechanism 140. The latch mechanism 140 has a first member 142 and a second member 144 which are connected by a pivotable attachment member 146 which in the exemplary embodiment is a screw type device, however the pivotable attachment member 146 may be a clamp, hinge or other like members. In the exemplary embodiment, the first member 142 is pivotably attached to the right xerographic tower 122. The first member 142 has a ball joint 148 attached at one end, but in the exemplary embodiment the ball joint 148 is attached to the end which is attached to the right xerographic tower 122. The ball joint 148 allows the first member 142 to pivot along the X axis. The other end of the first member 142 is connected to the second member 144 and is also able to pivot along the X axis due to the pivotable attachment member 146. In the exemplary embodiment, the second member 144 has a slot portion 150 which is able to receive the first member 142, and also allows the first member 142 to move along the X axis.

The second member 144 is pivotably connected at the other end to a U-shaped bracket 152. The second member 144, and accordingly the members attached to the second member, are able to rotate along the Y axis. The U-shaped bracket is attached to an outer frame 154 portion of the image forming apparatus 100. The U-shaped bracket 152 is attached to the second member 144 in such a manner, so that the second member 144 is able to freely rotate along the Y axis. This feature allows the user to move the right xerographic tower 122 and a pre-fuser transport (not shown) in an upward direction to gain access to the two components.

The first member 142 has a first handle 160. In the exemplary embodiment the first handle 160 extends upwards, along the Y-axis, and is attached to the first member 142. The second member 144 has a second handle 162. The second handle 162 extends along the X axis, and has curved shape. It should be appreciated that the present invention may operate with one handle, but in the exemplary embodiment the latch mechanism 140 has two handles 160 and 162. The handles 160 and 162 allow the user to move the latch mechanism 140 which accordingly moves the modular components apart as shown in FIGS. 4 and 5. Furthermore, as shown in FIG. 6, the handles 160 and 162 have a gripping member 164 attached to the handles 160 and 162 to allow the user to grip the handles with greater ease. Also, a safety cover 165 may surround the latch mechanism 140 so that user's hand or other objects do not get caught within the components of the latch mechanism 140.

The present invention also includes a first structure, 180 located on the second handle 162 and extending upwardly, and a second structure 182 located on the bracket 152 and also extending upwardly. An elastic spring 184 is connected between the first and second structures 180 and 182, and applies a force which pulls the second handle clockwise toward a locked position.

Figure 7:
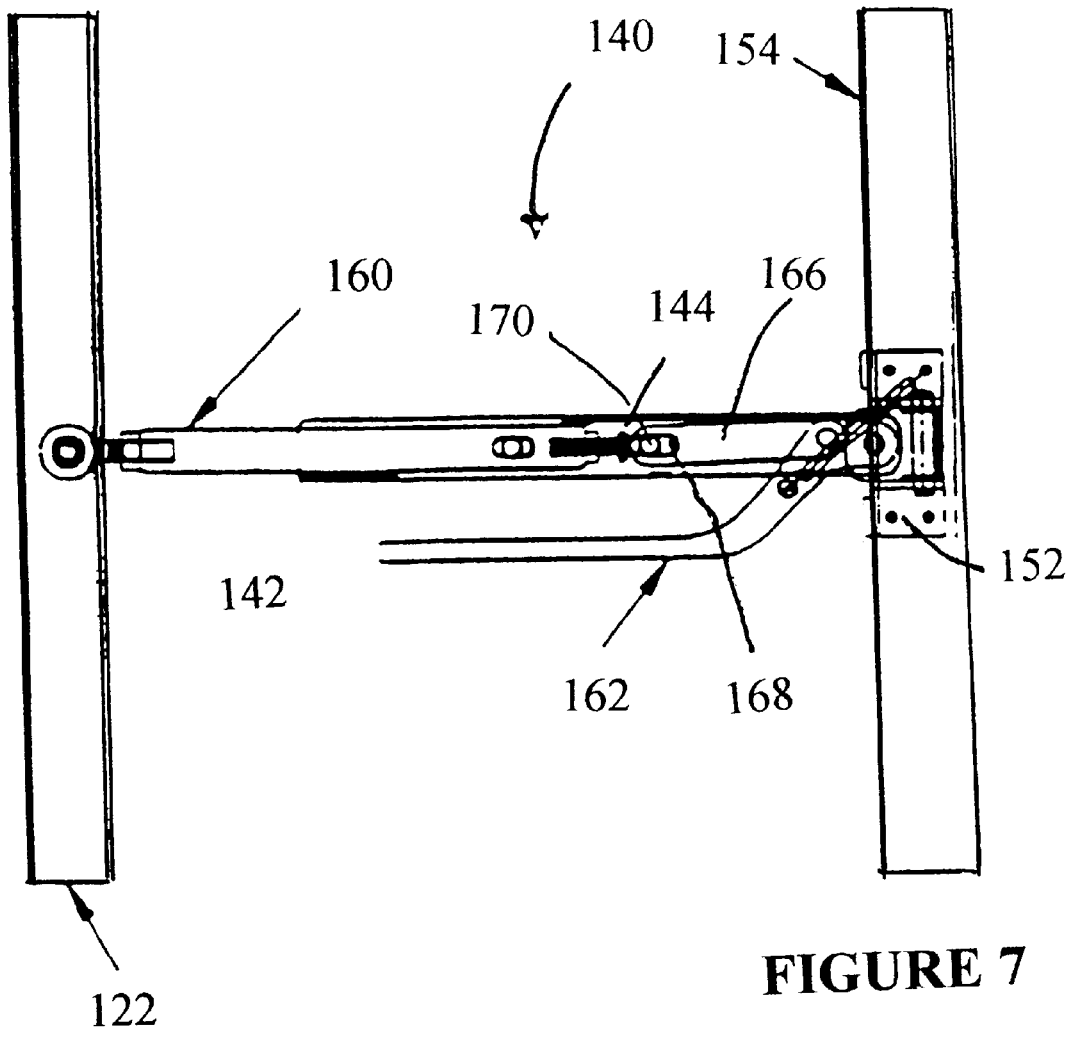
FIG. 7 is a top view of the latch mechanism in a full closed position.
Figure 8:
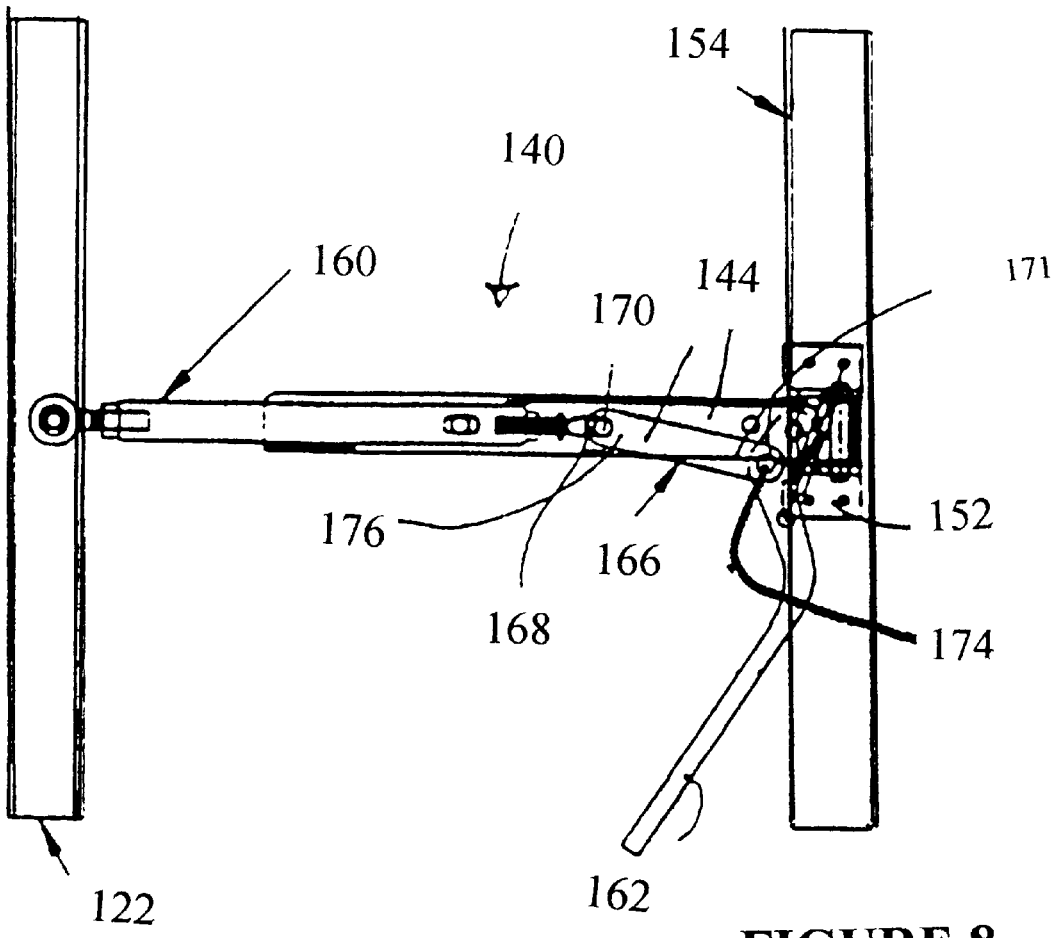
FIG. 8 is a top view of the latch mechanism in a semi-open position with the first handle in a locked position and the second handle in an open position.
Figure 9:
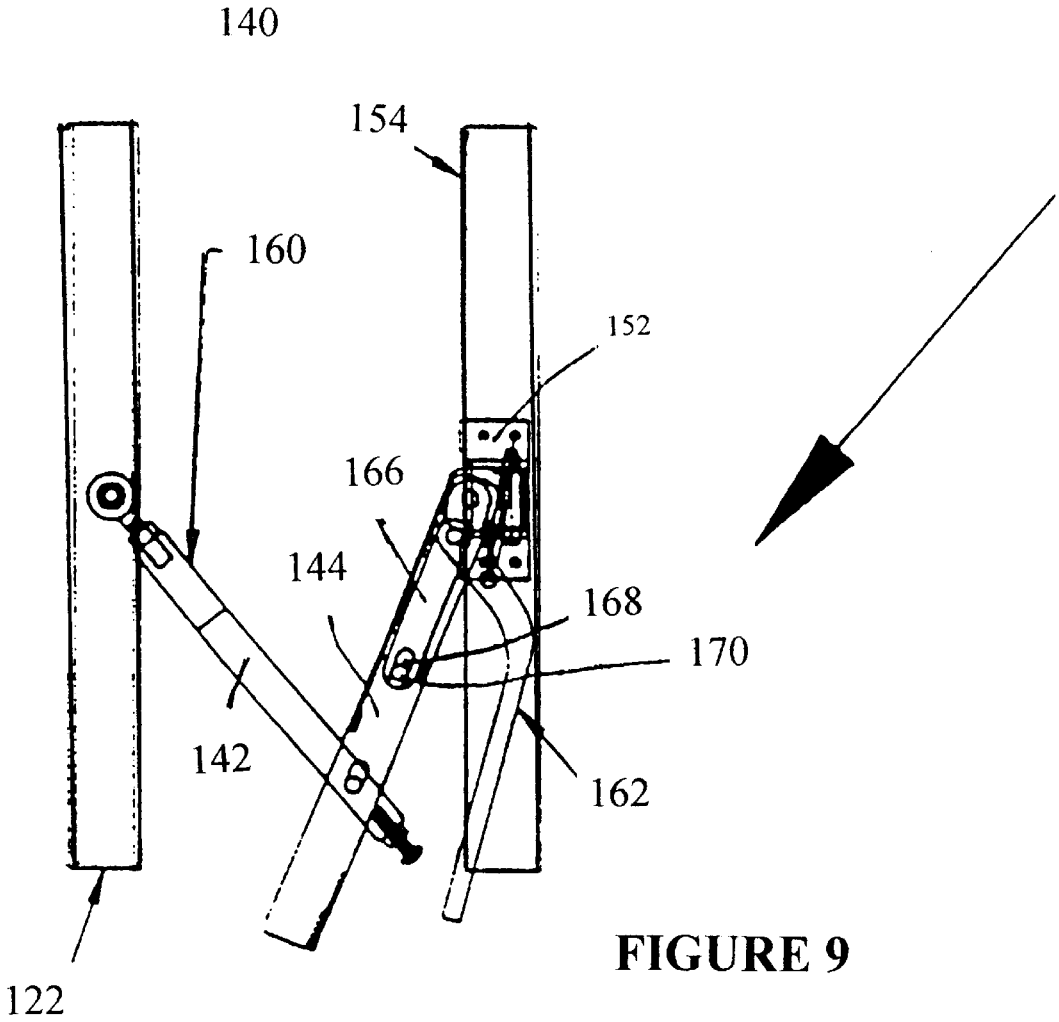
FIG. 9 is a top view of the latch mechanism in a full open position with the first handle and the second handle in an open position.

To unlock the latch mechanism 140, various steps and procedures may be performed, but a description will be given according to one possible configuration of the latch mechanism 140. FIG. 7 shows the latch mechanism. 140 in a locked position with the first and second handles 160 and 162 in a locked position. FIG. 8 shows the latch mechanism in a semi-open position with the first handle 160 in a locked position and the second handle 162 moved to an unlocked position. FIG. 9 shows the latch mechanism 140 in an open position with the first handle 160 and the second handle 162 in an open position.

A detailed explanation of the operation of the latch mechanism 140 will be given with respect to one of the exemplary embodiments as illustrated in FIGS. 7–9. In FIG. 7, the latch mechanism 140 is in a locked position, therefore allowing almost no pivotable movement. In the locked position, the first and second members 142 and 144 are substantially aligned end to end, thus forming a brace for preventing movement of the modular components. The latch mechanism 140 is held in a locked by a link member 166 which is pivotally attached to the second handle 162 by a first pivoting member 170 and pivotally attached to the second member 144 by a second pivoting member 174. The link member 166 is over center of the second member 144 when the latch mechanism 140 is in a locked position, thus maintaining the first and second members 142 and 144 in their end to end alignment. The end of the link member 166 opposite to the end connected to the second handle 162 is connected to a slotted portion 168 on the top portion or located within the slot portion 150 of the second member 144. When the second handle 162 is rotated, the link member 166 is able to translate along the slotted portion 168 and also pivot with respect to the first pivoting member 170. However, in the locked position, the pivoting member 174 is pressed against one end of the slotted portion 168, thus bracing the link member 166 between the first pivoting member 170 and the second pivoting member 174. When the link member 166 is in the locked position, the first and second members 142 and 144 can not pivot relative to each other because the handle 162, and thus adjust the end 171 of the link member 166 maintains its position. Furthermore, the elastic spring 184 pulls the handle 162, and thus adjusts the end of 171 of the link member 166 towards a locked position.

FIG. 8 shows the latch mechanism 140 in a semi-open position. In this position, the second handle 162 is pivoted outwards or counterclockwise. Because the link member 166 is pivotably connected to the second handle 162 by the first pivoting member 170, the first end portion 171 of the link member 166 which is connected to the second handle 162 is pivoted in a clockwise direction. The second pivoting member 174 at the second end portion 176 is moved along the slot portion 168 towards the outer frame 154. In this position, the first and second members 142 and 144 are no longer braced and are capable of pivotal movement relative to each other.

FIG. 9 shows the latch mechanism 140 in a full open position with both the handles 160 and 162 and the first and second members 142 and 144 in an open position. After the second handle 162 is rotated counterclockwise until the second handle 162 is no longer able to rotate, the user is able to pull the first handle 160 to rotate the first member 142 in a clockwise direction and the second member 144 in a counterclockwise direction. As shown in FIG. 9, the first and second members 142 and 144 form a V-shape when in the full open position. It should be appreciated that the latch mechanism 140 could be configured so that the latch mechanism 140 is able to open in the opposite direction. The outer frame 154 is a static structure, thus, when the first handle 160 is being pulled to an open position, the first member 142 pulls the right xerographic tower 122 toward the outer frame 154. As shown in FIG. 4 when the latch mechanism 140 is in an open position, the modular components 114, 118 and 122 are pulled towards the outer frame and are separated from one another.

One of the advantages of the present invention is that the latch mechanism 140 allows the user to consume very little energy or power in order to separate the modular components or to lift the right xerographic tower along with the pre-fuser transport. The latch mechanism 140 is a manually operated two handle device and allows the user to quickly unlock and lock the modular components in less than 11 seconds. It should be noted that the latch mechanism 140 is not only useful in moving components in an image forming apparatus, but may be used wherever a large motion and large force is required in a small area with manual power. The second handle 162 is primarily used to move to link member 166 from a locked position to an unlocked position, and moves the modular components a small distance. The first handle's 160 primary purpose is to move the modular components to an unlocked position and separate the modular components from one another.

Figure 10:
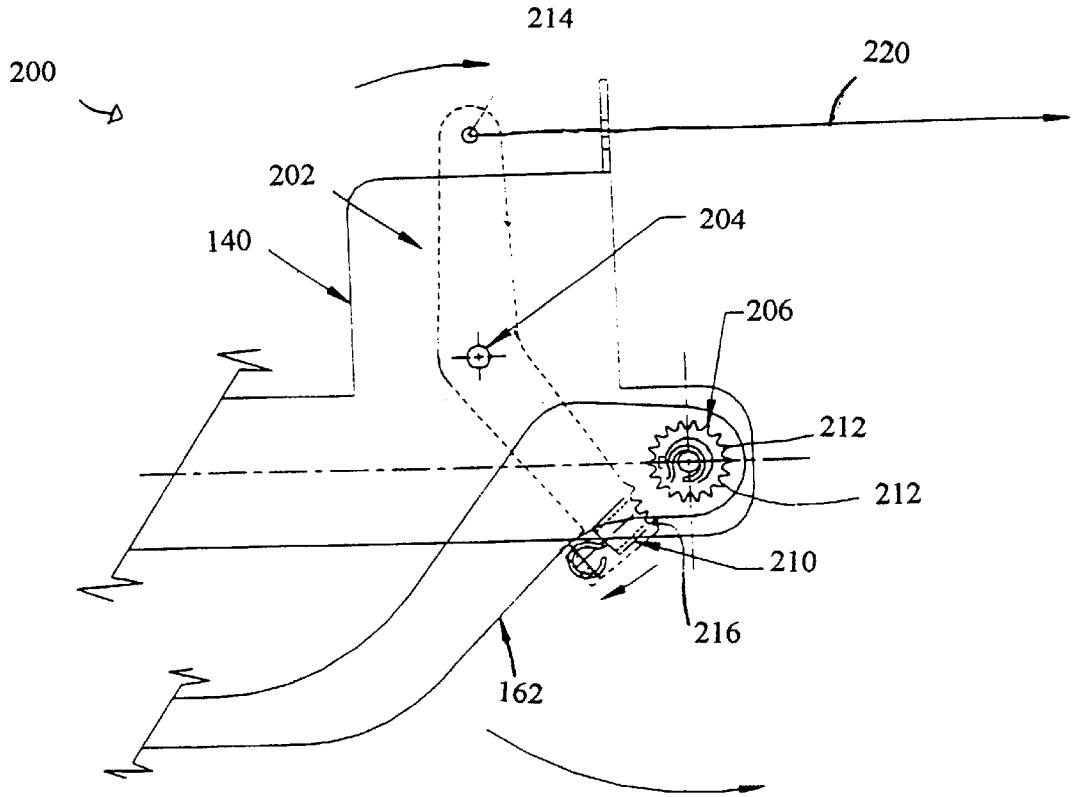
FIG. 10 is a top view of the locking mechanism.

One of the problems with engaging and disengaging the xerographic towers 114 and 122 and the photoreceptor is that if the user does not follow proper procedural steps the xerographic towers 114 and 122 and the photoreceptor may collide and damage the components. Therefore, a locking mechanism 200 has been designed to solve this problem. The locking mechanism 200, as shown in FIG. 10, generally comprises a locking fork 202, a pivotably attachable member 204, a pivoting pinion shaft key 206 and a spring 210.

The locking mechanism 200 may be implemented in any type of rotary motion device to lock one or more members into a locked position. However, a description of the locking mechanism 200 will be given in relation to lock the latch mechanism 140, which is in a locked position until the user has moved the pre-fuser transport.

The pivoting pinion shaft key 206 is attached to the second handle 162 of the latch mechanism 140. The pivoting pinion shaft key 206 has a plurality of teeth 212 which surround the outer circumference of the pivoting pinion shaft key 206. The locking fork 202 is pivotally attached to the second member 144 by the pivotably attachable member 204. On one end of the locking fork 202 is a spring 210 and on the opposite end is an opening 214. The end having the spring 210 also has a plurality of teeth 216 which are configured to engage and lock with the teeth 212 of the pivoting pinion shaft key 206. The teeth 216 located on the fork 202 are designed to fully conform to the teeth 212 of the pivoting pinion shaft key 206 at any point of rotation of the fork 202 and pivoting pinion shaft key 206 assembly.

The end of the fork 202 opposite to that of the spring 210 has an opening 214 which is able to receive a cable 220. The cable 220 connects the fork 202 to the pre-fuser transport (not shown). When the pre-fuser transport is moved into proper position, the cable 220 pulls the fork 202 in a clockwise direction, thus disengaging the teeth 212 of the pivoting pinion shaft key 206 from the teeth 216 of the fork 202. Until the prefuser transport is moved, the teeth 216 of the fork 202 mesh against the teeth 212 of the pinion shaft key 206, thus preventing pivotal movement of the handle 162. However, once the prefuser transport is moved, the teeth 216 disengage from the teeth 212. Therefore, the user is able to move the second handle 162 to open up the latch mechanism 140. Unless the pre-fuser is moved into proper position, a user can not accidentally open the latch mechanism 140 and damage the prefuser transport. Furthermore, the spring 210 applies a locking force between the fork 202 and the pivoting pinion shaft key 206 producing a normally locked condition.

The pinion shaft key 206 is made from gear stock which is cheap and relatively durable. The locking member 200 allows a cheap locking device to be implemented to lock one or more devices in position.

While this invention has been described in conjunction with the exemplary embodiments outlined above, it is evident that may alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A locking mechanism for selectively preventing rotational movement of a handle relative to a frame, comprising:

a fork member having first and second ends and pivotally attached to the frame member at a pivot located between the first and second ends;

a first locking device located at the first end of the fork member;

a second locking device located on the handle and engaging the first locking device on the first end of the fork member for preventing rotational movement of the handle in either rotational direction;

an elastic member for biasing the first and second locking devices into engagement; and an attachment mechanism located at the second end of the fork member such that a tension force on the attachment mechanism pivots the fork member about the pivot member to disengage the first and second locking devices and allow the handle relative to the frame.

2. The locking mechanism claimed in claim 1, wherein the first locking device has a first plurality of teeth, and the second locking device is a pinion having a second plurality of teeth such that the first plurality of teeth are able to communicate with the second plurality of teeth to lock the fork member and the handle in a fixed position.

3. The locking mechanism claimed in claim 1, wherein the attachment mechanism comprises a cable which is connected to a member that has to be moved to a predetermined position before the handle is allowed to rotate relative to the frame.

4. The locking mechanism claimed in claim 1, wherein the second locking device is made from gear stock.

5. The locking mechanism claimed in claim 1, wherein the handle is a handle of a latch mechanism.

6. The locking mechanism claimed in claim 1, wherein the elastic member is located on the first end of the fork member.

7. The locking mechanism claimed in claim 6, wherein the elastic member is a spring.

* * * * *